United States Patent [19]

Diziere

[11] 4,241,384

[45] Dec. 23, 1980

[54] NOVEL CASE FOR AN ELECTRIC POCKET FLASHLIGHT

[75] Inventor: Bernard Diziere, Cholet, France

[73] Assignee: Societe d'Exploitation des Etablissements Bregeon-Cochard, Maulevrier, France

[21] Appl. No.: 22,457

[22] Filed: Mar. 21, 1979

[30] Foreign Application Priority Data

Mar. 29, 1978 [FR] France ..... 78 10686

[51] Int. Cl.[3] ..... F21L 7/00

[52] U.S. Cl. ..... 362/203; 362/205; 362/208

[58] Field of Search ..... 362/203, 208, 205

[56] References Cited

U.S. PATENT DOCUMENTS 2,599,254 6/1952 Gits et al. ..... 362/208

*Primary Examiner*—Stephen J. Lechert, Jr.

*Attorney, Agent, or Firm*—Diller, Ramik & Wight

[57] ABSTRACT

The invention relates to a case of plastics material for an electrical pocket flashlight or pocket lamp energized by battery. It is composed of two bodies, an inner and an outer, assembled together by clipping, the upper body including the parabolic reflector into which a shouldered socket holder ring is adjusted. The metal socket inserted therein has a base provided with a flexible metal strip. In the lower body, slides a cradle supporting the battery and bringing by vertical translation, under the effect of a push-button, the terminals of the battery into contact with the metal strip and the base of the flashlight bulb.

14 Claims, 4 Drawing Figures

NOVEL CASE FOR AN ELECTRIC POCKET FLASHLIGHT

BACKGROUND OF THE INVENTION

1. Field of the Invention

The present invention relates to cases for electric pocket lamps or flashlights energized by batteries.

2. Description of the Prior Art

It is more and more conventional to substitute for metal pocket flashlight cases, cases formed of plastics material in order to overcome the drawbacks inherent in the former. In fact, on the one hand, poor operation was generally due to poor contacts or poor insulation of certain elements; on the other hand, metal cases were often deteriorated by rapid oxidation caused by the decomposition of discharged batteries that they contained at the end of a certain period of non-use. If the use of plastics materials has been able to remedy the second drawback mentioned, the presently known constructions still use the same type of contact, consisting of placing each of the terminals of the battery in permanent connection with a flexible metal strip of which on end is at the tip of the base of the flashlight bulb and the other is urged against the cylindrical portion of the socket by elastic deformation under the effect of a push-button movable in translation, thus closing the electrical circuit. These contact strips are either incorporated in the mold before the injection of the plastics material, or introduced, after unmolding the case, into housings provided for this purpose. Both of these methods of manufacture have the drawback of being costly and often of being deteriorated in the areas of implantation of the contact strips by reason of the variation in elasticity of plastics materials under the influence of low temperature or of ageing.

To avoid the presence of contact strips, U.S. Pat. No. 1,404,077 provides a removable battery in the case of an electric flashlight. The battery-bulb electrical circuit is closed or opened by actuating an external push-button on the case which permits the battery to be moved axially in order to bring the stud of the battery into contact or out of contact with the base of the bulb. Such a system being designed only for cylindrical batteries, and not being provided in any way for forming from plastics material, it does not resolve the above-mentioned problems.

Pocket flashlights are also known such as those described in French Pat. No. 69 16,548, which include a onepiece part for fixing the illuminating head as well as the housing of the bulb, said part being formed of an electrically insulating material. This French Pat. No. 69 16,548 describes pocket flashlights provided only for cylindrical batteries and in addition including two metal pins 7 and 9 and a switch device provided with a strip in contact with the pole of the battery opposite the stud of said cylindrical battery and coming into contact with one of the pins.

Pocket lamps according to the French patent mentioned have a complex assembly and are costly to manufacture.

It is an object of the present invention to provide a case which enables all of the above-described drawbacks to be avoided, limiting the number of metal parts entering into its construction to one, which part, if necessary, can easily be replaced in the case of deterioration.

GENERAL DESCRIPTION OF THE INVENTION

According to the invention there is provided a case constituted principally of a lower body and an upper body of plastics material assembled by elastic clipping. The upper body includes the parabolic reflector and the glass as well as a dismountable shouldered ring formed of plastics material molded on a metal socket including, produced by embossing, threads into which the flashlight bulb is screwed, which metal socket includes at its base a flexible metal strip designed to form the contact with the pole of the battery. The lower body, of rectangular section, includes, at the top part of one of its small faces, a groove opening in the plane of the joint of the upper and lower bodies in which the axle of a push-button moves in translation, which actuates the alternate vertical movement of a cradle supporting the battery so as to bring the terminals of the latter into contact with the metal strip of the socket and at the base of the bulb to close the electrical circuit.

BRIEF DESCRIPTION OF THE DRAWINGS

The accompanying drawings illustrate, by way of example, a preferred embodiment of the case according to the present invention. In the drawings.

DESCRIPTION OF PREFERRED EMBODIMENT

Figure 1:
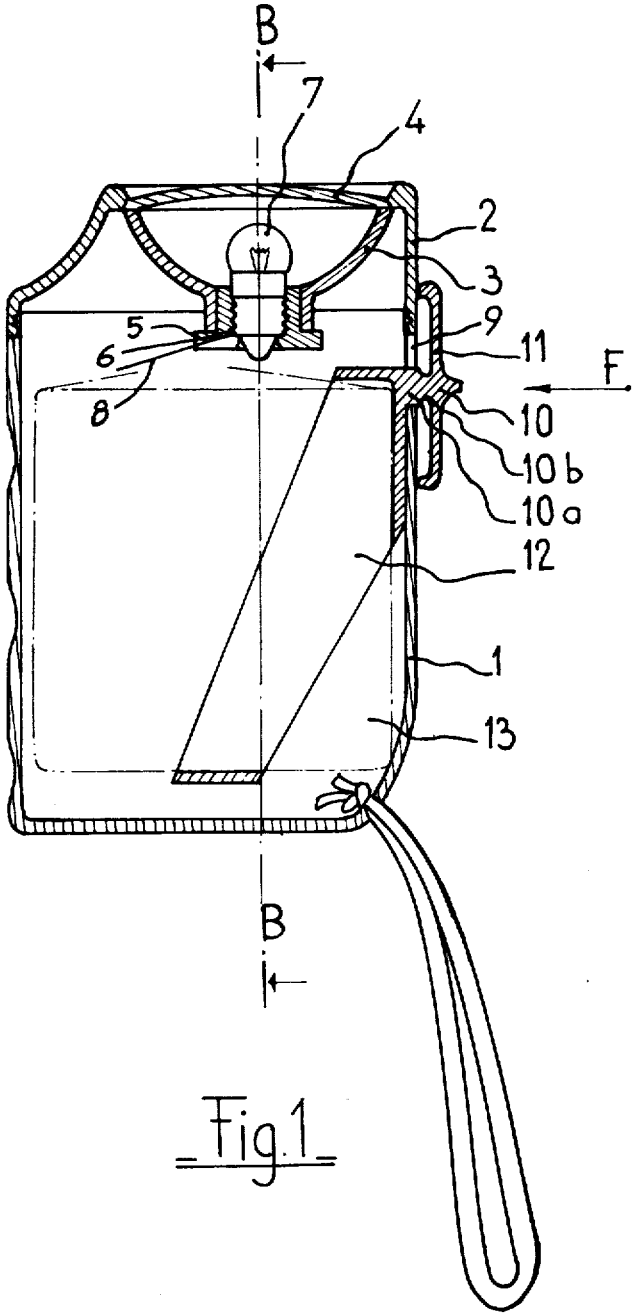
FIG. 1 is a view in elevation of a section along the line AA of an embodiment of a case according to the invention.
Figure 2:
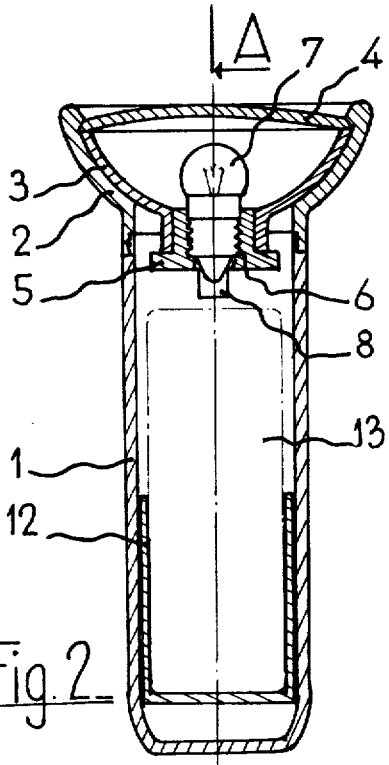
FIG. 2 shows a cross-section along the line BB of the embodiment of FIG. 1.
Figure 3:
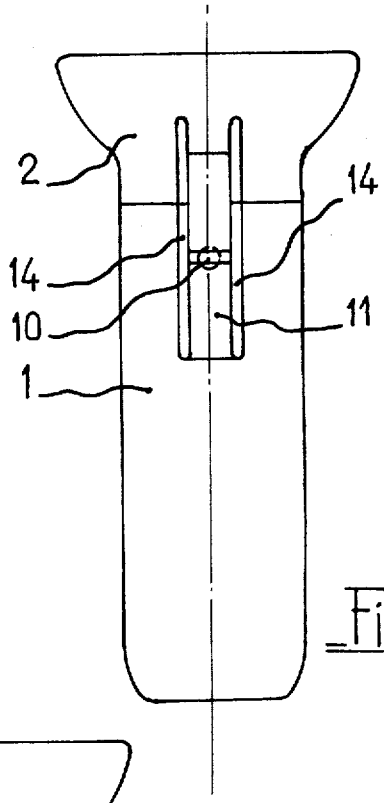
FIG. 3 shows an end view on the push-button side.
Figure 4:
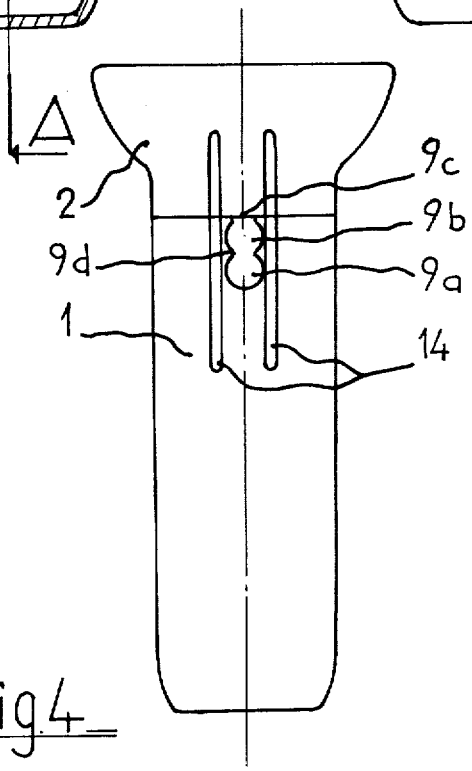
FIG. 4 shows an end view on the push-button side the latter being supposed removed.

As illustrated, the embodiment of the case according to the invention is constituted by a lower body 1 and an upper body 2 assembled together by clipping along a horizontal joint. The upper body includes at the top part a hemispherical bulge in which is embedded a parabolic reflector 3 held in position by the placing of the glass 4 in the bevelled shoulder that the edges of the hemispherical bulge form, producing by the elasticity of the material a crimping of the assembly. The reflector 3 carries at its center a bore into which is adjusted forcibly a shouldered ring 5 formed of plastics material molded on a metal socket 6 including, produced by embossing, threads in which the flashlight bulb 7 is screwed. The base of the socket 6 includes a flexible metal strip 8 designed to form the contact with a pole of the battery.

The lower body 2, of rectangular section, includes, at the top part of one of its small faces, a groove 9 opening in the joining plane of the upper and lower bodies in which the axle 10 of a push-button 11 moves in translation actuating the alternate vertical movement of a cradle 12 supporting, laterally and below and above, the battery 13, so as to place the terminals of the latter in or out of contact with the metal strip 8 of the socket 6 and with the base of the bulb 7. The lateral sides of the cradle are inclined to locate the lower cross-piece under the middle portion of the battery, the upper retaining part being limited to some millimeters covering at the transverse edge of the battery so as to not interfere with one of the terminals of the latter. Immobilization of the push-button 11 in "lit" or "out" position is obtained by the cut-out of the groove 9 which cut-out is composed of two secant circular orifices 9a and 9b, opening on the joining plane of the upper and lower bodies through a groove with parallel edges 9c. The diameter of the orifices 9a and 9b, on the one hand, and the width of groove 9c and of the neck 9d created by the intersection of said orifices, on the other hand, correspond respectively, within operational tolerances, to the stepped diameters 10a and 10b of the axle 10 of the push-button. The alternation of these diameters to enable the translation of said push-button is achieved by pressure along the arrow F, causing translation of the axle of the push-button in this direction, the placing of the diameter 10b opposite the thickness of the case being made possible by the elasticity of the wings of the push-button whose curved ends are supported permanently on the outer surface of the case. The vertical guidance in translation of the push-button is achieved by means of two ribs 14 framing said push-button laterally.

The invention is not limited in any way to the embodiment which has been particularly described, but it encompasses on the contrary, all possible modifications provided that the latter are not in contradiction with the subject of each of the claims appended to the present description.

Thus, the shouldered ring can include, formed of the material constituting it, threads into which the bulb is screwed, the flexible metal strip 8 then alone being incorporated with the ring so that its end may come into contact with the socket after screwing of the latter.

The invention is applicable to the production of any electric pocket lamp or flashlight cases.

I claim:

1. An electric pocket flashlight case comprising means for supporting a flashlight bulb in a position at which at least one contact thereof can be closed by movement of an associated flashlight battery wall means for defining a chamber and for housing therein an associated battery, means for supporting a flashlight battery within said chamber for movement between a first position spaced from the flashlight bulb contact and a second position contiguous thereto, and means for sliding said flashlight battery supporting means between said first and second positions thereby closing an associated circuit and lighting an associated flashlight bulb upon the movement of a flashlight battery to said second position.

2. The electric pocket flashlight case as defined in claim 1 wherein said wall means includes a body defining said chamber and a cap housing said flashlight bulb supporting means, said last-mentioned means being a flashlight bulb socket, a parabolic reflector associated with said socket, a metallic contact carried by said socket, and said case and all components thereof except said metallic contact being constructed from electrically nonconductive polymeric plastic material.

3. The electric pocket flashlight case as defined in claim 1 wherein said flashlight battery supporting means is a cradle defined at least in part by a generally U-shaped portion as viewed generally normal to the direction of sliding movement of said cradle.

4. The electric pocket flashlight case as defined in claim 1 including means for mounting said flashlight battery supporting means for limited movement normal to the direction of sliding movement thereof.

5. The electric pocket flashlight case as defined in claim 1 wherein said sliding means includes an elongated slot in said wall means through which projects to the exterior a portion of said flashlight battery supporting means.

6. The electric pocket flashlight case as defined in claim 1 wherein said sliding means includes a post carried by said flashlight battery supporting means projecting to the exterior of said wall means through an elongated slot therein, said elongated slot having a longitudinal axis disposed in the direction of sliding movement of said flashlight battery supporting means, said elongated slot having opposite slot portions and a medial slot portion therebetween, said post having two post portions of two different sizes an outermost one of which is smaller than an innermost one thereof, said medial slot portion corresponding in size to said outermost post portion, and said opposite slot portions corresponding in size to said innermost post portion whereby said post must be moved inwardly relative to said chamber to align said outermost post portion with said opposite slot portions to slide said flashlight battery supporting means between said first and second positions.

7. The electric pocket flashlight case as defined in claim 1 wherein said sliding means includes a post carried by said flashlight battery supporting means projecting to the exterior of said wall means through an elongated slot therein, said elongated slot having a longitudinal axis disposed in the direction of sliding movement of said flashlight battery supporting means, said elongated slot having opposite slot portions and a medial slot portion therebetween, said post having two post portions of two different sizes an outermost one of which is smaller than an innermost one thereof, said medial slot portion corresponding in size to said outermost post portion, said opposite slot portions corresponding in size to said innermost post portion whereby said post must be moved inwardly relative to said chamber to align said outermost post portion with said opposite slot portions to slide said flashlight battery supporting means between said first and second positions, said wall means including a cap and a body defining said chamber, said cap and body having peripheral edges in mating relationship, means for removably securing together said cap and body at said peripheral edges, and one of said opposite slot portions opens through said body peripheral edges whereby with said cap removed from said body said flashlight battery supporting means can be readily assembled to or disassembled from said body.

8. The electric pocket flashlight case as defined in claim 1 wherein said sliding means includes a post carried by said flashlight battery supporting means projecting to the exterior of said wall means through an elongated slot therein, said elongated slot having a longitudinal axis disposed in the direction of sliding movement of said flashlight battery supporting means, said slot having longitudinally opposite slot portions, said wall means including a cap and a body defining said chamber, said cap and body having peripheral edges in mating relationship, means for removably securing together said cap and body at said peripheral edges, and one of said opposite slot portions opens through said body peripheral edge whereby with said cap removed from said body said flashlight battery supporting means can be readily assembled to or disassembled from said body.

9. The electric pocket flashlight case as defined in claim 1 wherein said flashlight battery supporting means is constructed entirely from electrically nonconductive polymeric plastic material.

10. The electric pocket flashlight case as defined in claim 1 including in combination therewith a flashlight battery having opposite ends one of which includes positive and negative contacts, both of said positive and negative contacts being open when said flashlight battery supporting means is in said first position, and both of said positive and negative contacts being closed when said flashlight battery supporting means is moved to said second position.

11. The electric pocket flashlight case as defined in claim 1 wherein said sliding means includes a post carried by said flashlight battery supporting means projecting to the exterior of said wall means through an elongated slot therein, said elongated slot having a longitudinal axis disposed in the direction of sliding movement of said flashlight battery supporting means, and means carried by said post for resiliently biasing said flashlight battery supporting means in a direction generally normal to the direction of sliding movement and toward the exterior of said wall means.

12. The electric pocket flashlight case as defined in claim 1 wherein said sliding means includes a post carried by said flashlight battery, supporting means projecting to the exterior of said wall means through an elongated slot therein, said elongated slot having a longitudinal axis disposed in the direction of sliding movement of said flashlight battery supporting means, means carried by said post for resiliently biasing said flashlight battery supporting means in a direction generally normal to the direction of sliding movement and toward the exterior of said wall means, and said resilient biasing means being a resilient head carried by said post exteriorly of said wall means.

13. The electric pocket flashlight case as defined in claim 1 wherein said flashlight battery supporting means is a cradle defined at least in part by a generally U-shaped portion as viewed generally normal to the direction of sliding movement of said cradle, said U-shaped portion being defined by a lower cross-piece adapted to support a battery thereupon and a pair of upwardly inclined lateral sides, and an upper cross-piece spanning said lateral sides and being adapted to overlie at least a portion of a battery adapted to be supported upon said lower cross-piece.

14. The electric pocket flashlight case as defined in claim 1 wherein said flashlight battery supporting means is a cradle defined at least in part by a generally U-shaped portion as viewed generally normal to the direction of sliding movement of said cradle, said U-shaped portion being defined by a lower cross-piece adapted to support a battery thereupon and a pair of upwardly inclined lateral sides, and an upper cross-piece spanning said lateral sides and being adapted to overlie at least a portion of a battery adapted to be supported upon said lower cross-piece, and means exteriorly of said wall means for cooperatively guiding said resilient biasing means for sliding movement with said flashlight battery sliding means.

* * * * *